US010173424B2

(12) United States Patent
Matsuo

(10) Patent No.: US 10,173,424 B2
(45) Date of Patent: Jan. 8, 2019

(54) LIQUID EJECTING HEAD, LIQUID EJECTING APPARATUS, AND METHOD FOR MANUFACTURING LIQUID EJECTING HEAD

(71) Applicant: SEIKO EPSON CORPORATION, Tokyo (JP)

(72) Inventor: Yasuhide Matsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 15/694,125

(22) Filed: Sep. 1, 2017

(65) Prior Publication Data

US 2018/0079209 A1 Mar. 22, 2018

(30) Foreign Application Priority Data

Sep. 21, 2016 (JP) ..... 2016-183926
Nov. 24, 2016 (JP) ..... 2016-227447

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/161* (2013.01); *B41J 2/162* (2013.01); *B41J 2/1606* (2013.01); *B41J 2/1623* (2013.01); *B41J 2002/14419* (2013.01); *B41J 2002/14491* (2013.01)

(58) Field of Classification Search
None
See application file for complete search history.

(56) References Cited

U.S. PATENT DOCUMENTS

2009/0091604 A1* 4/2009 Bell ..... B41J 2/1603 347/64
2013/0187991 A1* 7/2013 Watanabe ..... B41J 2/14274 347/71
2014/0338833 A1* 11/2014 Kanungo ..... B41J 2/1607 156/281

FOREIGN PATENT DOCUMENTS

| | | |
|---|---|---|
| JP | 2015-160386 | 9/2015 |
| JP | 2015-160387 | 9/2015 |
| JP | 2016-068539 | 5/2016 |
| JP | 2017-024373 | 2/2017 |
| WO | 2017-017899 | 2/2017 |

* cited by examiner

*Primary Examiner* — Erica Lin
(74) *Attorney, Agent, or Firm* — Workman Nydegger

(57) ABSTRACT

Provided is a liquid ejecting head including: a first substrate in which a space serving as a flow path is formed in a state of having an opening on a surface of one side thereof; and a second substrate which seals the opening from the surface on the one side of the first substrate, divides the flow path, and is made of resin, in which the first substrate and the second substrate adhere to each other via a first adhesive layer which is laminated on the surface on the one side of the first substrate and which is made of a silicone-based adhesive and a second adhesive layer which is laminated on the first adhesive layer and which is made of an epoxy-based adhesive.

11 Claims, 7 Drawing Sheets

| | TaOx | SUS | Al | Fe |
|---|---|---|---|---|
| SHEAR STRENGTH | ◎ | ○ | ○ | ○ |

LIQUID EJECTING HEAD, LIQUID EJECTING APPARATUS, AND METHOD FOR MANUFACTURING LIQUID EJECTING HEAD

BACKGROUND

1. Technical Field

The present invention relates to a liquid ejecting head including a substrate made of resin, a liquid ejecting apparatus, and a method for manufacturing a liquid ejecting head.

2. Related Art

As a liquid ejecting apparatus including a liquid ejecting head, for example, there is an image recording apparatus such as an ink jet type printer and an ink jet type plotter and recently, a liquid ejecting apparatus having a feature that a very small amount of liquid can be accurately landed to a predetermined position is developed and then is also applied to various manufacturing apparatus. For example, the liquid ejecting apparatus is applied to a display manufacturing apparatus for manufacturing a color filter such as a liquid crystal display, an electrode forming apparatus for forming an electrode such as an organic electro luminescence (EL) display and a face emitting display (FED), and a chip manufacturing apparatus for manufacturing a biochip (biochemical element). In the image recording apparatus, liquid ink is ejected from the liquid ejecting head and a solution of each color material of red (R), green (G), and blue (B) is ejected from the liquid ejecting head in the display manufacturing apparatus. In addition, in the electrode forming apparatus, a liquid electrode material is ejected from a liquid ejecting head and in a chip manufacturing apparatus, a solution of a biological organic material is ejected from a liquid ejecting head.

The liquid ejecting head described above includes, for example, a nozzle plate on which a plurality of nozzles are formed, a pressure chamber forming substrate on which a plurality of spaces serving as pressure chambers communicating with the respective nozzles are formed, a communication substrate in which a space serving as a common liquid chamber (also referred to as "manhole") supplying liquid to the respective pressure chambers is formed, or the like. In addition, as a liquid ejecting head, there is a liquid ejecting head in which a portion of the space serving as the common liquid chamber (manhole portion) is divided by a flexible thin film (for example, a thin-film substrate made of resin) (see, for example, JP-A-2016-068539). The liquid ejecting head absorbs the pressure fluctuation in the common liquid chamber by the thin film. In addition, as adhesives which adhere such a thin film to the communication substrate, silicone-based adhesives are used (see, JP-A-2016-068539).

However, in a case of adhering using the silicone-based adhesives, there is a fear that components (for example, sulfur (S), nitrogen (N), plasticizer, or the like) included in the thin film which is made of resin become a catalyst poison, curing of the silicone-based adhesives is inhibited, and thus an adhesive force is decreased. In particular, in the liquid ejecting head, since an additive reaction type silicon-based adhesive is suitably used, such a problem is likely to be generated.

SUMMARY

An advantage of some aspects of the invention is to provide a liquid ejecting head that suppresses a decrease in an adhesive force between a substrate made of resin and another substrate, a liquid ejecting apparatus, and a method for manufacturing a liquid ejecting head.

According to an aspect of the invention, there is provided a liquid ejecting head including, a first substrate in which a space serving as a flow path is formed in a state of having an opening on a surface of one side thereof, and a second substrate which seals the opening from the surface on the one side of the first substrate, divides the flow path, and is made of resin, in which the first substrate and the second substrate adhere to each other via a first adhesive layer which is laminated on the surface on the one side of the first substrate and which is made of a silicone-based adhesive and a second adhesive layer which is laminated on the first adhesive layer and which is made of an epoxy-based adhesive.

According to the configuration, since the second substrate is bonded to a first substrate side via the second adhesive layer made of an epoxy-based adhesive, decrease in an adhesive force of the first adhesive layer made of a silicon-based adhesive can be suppressed by components included in resin. As a result, since peeling of the second substrate can be suppressed, reliability of the liquid ejecting head can be increased.

In addition, in the configuration, it is preferable that the liquid ejecting head further include a third substrate which adheres to a region deviating from a region on the surface on the one side of the first substrate where the second substrate adheres and the first substrate and the third substrate adhere to each other via the first adhesive layer laminated on the surface on the one side of the first substrate.

According to the configuration, since the first adhesive layer can be shared between the first substrate and the second substrate and between the first substrate and the third substrate, the configuration of the liquid ejecting head is simplified.

Further, in any of the configurations described above, it is preferable that the first adhesive layer contain an epoxy group.

According to the configuration, adhesion (that is, adhesive force) between the first adhesive layer and the second adhesive layer can be increased.

In addition, in any of the configurations described above, it is preferable that a Young's modulus of the first adhesive layer be less than that of the second adhesive layer.

According to the configuration, even if a shear stress is generated between the first substrate and the second substrate due to the difference between a linear expansion coefficient of the first substrate and a linear expansion coefficient of the second substrate, the stress can be relieved by the second adhesive layer.

Further, in any of the configurations described above, it is preferable that the first adhesive layer include a curing acceleration catalyst including platinum, and a co-catalyst layer including tantalum oxide be formed on a region of the surface on the one side of the first substrate where at least the first adhesive layer is laminated.

According to the configuration, an effect of accelerating the curing of the first adhesive layer with the curing acceleration catalyst can be improved by the co-catalyst layer. As a result, an adhesive strength can be increased by the first adhesive layer.

Further, according to another aspect of the invention, there is provided a liquid ejecting apparatus including: the liquid ejecting head in any of the configurations described above.

According to the configuration, reliability of the liquid ejecting apparatus can be increased.

In addition, According to still another aspect of the invention, there is provided a method for manufacturing a liquid ejecting head of the invention which includes a first substrate in which a space serving as a flow path is formed in a state of having an opening on a surface of one side thereof and a second substrate which seals the opening from the surface on the one side of the first substrate, divides the flow path, and is made of resin, the manufacturing method including, forming a first adhesive layer made of a silicon-based adhesive on the surface on the one side of the first substrate and curing the first adhesive layer, and forming a second adhesive layer made of an epoxy-based adhesive on any one of a surface of the first adhesive layer laminated on the first substrate or a surface on one side of the second substrate facing the first substrate and adhering the first substrate and the second substrate to each other by curing the second adhesive layer in a state where the first adhesive layer and the second adhesive layer are sandwiched between the first substrate and the second substrate.

According to the method, since the first adhesive layer is cured prior to adhesion of the second substrate, decrease in the adhesive force of the first adhesive layer can be suppressed by the components included in the second substrate.

Further, in the manufacturing method described above, the first adhesive layer contains an epoxy group, and the forming of the first adhesive layer including forming the first adhesive layer in a semi-cured state in which a curing degree is progressed from the liquid state on the surface on the one side of the first substrate and fully curing the first adhesive layer in the semi-cured state after the forming of the first adhesive layer.

According to the method, migration of the epoxy group from the surface to an inside portion of the first adhesive layer can be suppressed. As a result, the epoxy group can remain on the surface of the first adhesive layer after the fully curing and the adhesion between the first adhesive layer and the second adhesive layer can be increased.

In addition, in any of the manufacturing method described above, it is preferable that the first adhesive layer include a curing acceleration catalyst including platinum, and a co-catalyst layer including tantalum oxide be formed on a region on the surface on the one side of the first substrate where at least the first adhesive layer is laminated.

According to the method, an effect of accelerating the curing of the first adhesive layer with the curing acceleration catalyst can be improved by the co-catalyst layer. As a result, an adhesive strength can be increased by the first adhesive layer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, aspects for realizing the invention will be described with reference to the attached drawings. In the embodiments described below, although various limitations have been made as preferred specific examples of the invention, the scope of the invention is not limited to the aspects unless specifically stated to limit the invention in the following description. In addition, in the following description, as an example of a liquid ejecting head of the invention, an ink jet type recording head (hereinafter, recording head) 3 mounted on an ink jet type printer (hereinafter, printer) 1 which is a type of liquid ejecting apparatus will be explained as examples.

Figure 1:
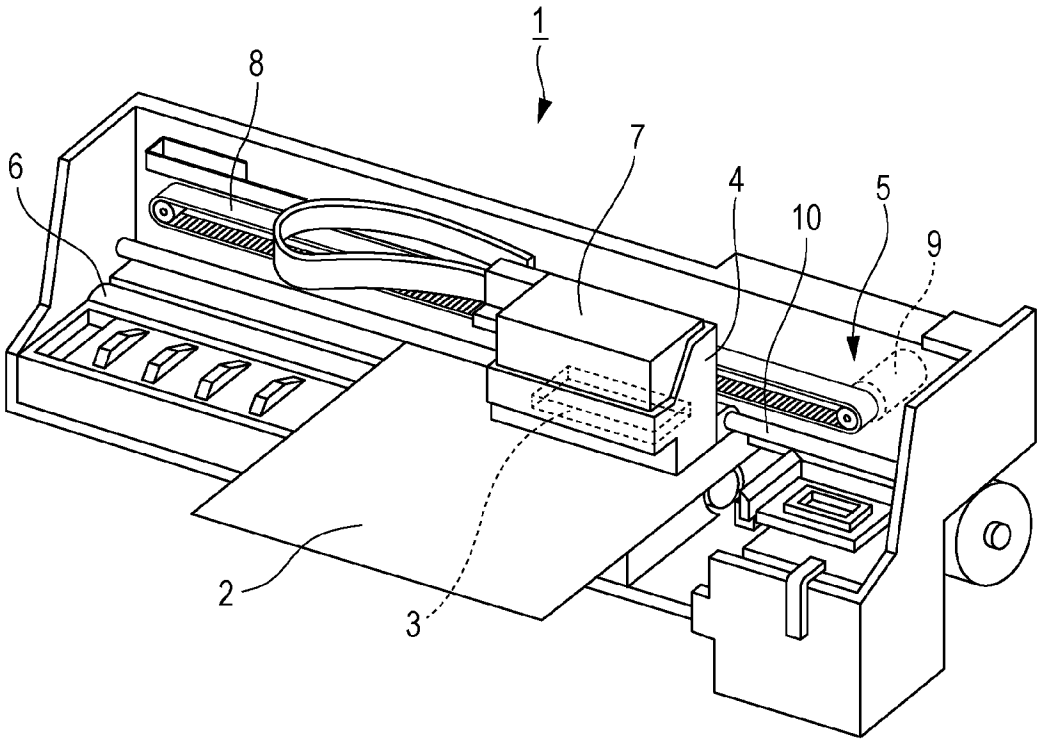
FIG. 1 is a perspective view illustrating a configuration of a printer.

FIG. 1 is a perspective view of the printer 1. The printer 1 is an apparatus that ejects ink (a type of liquid) onto a surface of a recording medium 2 (a kind of landing target) such as a recording paper and records an image or the like. The printer 1 includes a recording head 3, a carriage 4 to which the recording head 3 is attached, a carriage moving mechanism 5 which moves the carriage 4 in the main scanning direction, a transport mechanism 6 which transports the recording medium 2 in the sub scanning direction, and the like. Here, the ink is stored in an ink cartridge 7 as a liquid supply source. The ink cartridge 7 is detachably mounted on the recording head 3. A configuration in which the ink cartridge is disposed on a main body side of the printer and the ink is supplied from the ink cartridge to the recording head through an ink supply tube can be adopted.

The carriage moving mechanism 5 includes a timing belt 8. The timing belt 8 is driven by a pulse motor 9 such as a DC motor. Therefore, when the pulse motor 9 is operated, the carriage 4 is guided by a guide rod 10 installed on the printer 1 and thus reciprocates in the main scanning direction (in width direction of recording medium 2). A position of the carriage 4 in the main scanning direction is detected by a linear encoder (not illustrated) which is a type of position information detecting means. The linear encoder transmits the detection signal thereof, that is, the encoder pulse (a kind of position information) to a control unit of the printer 1.

Figure 2:
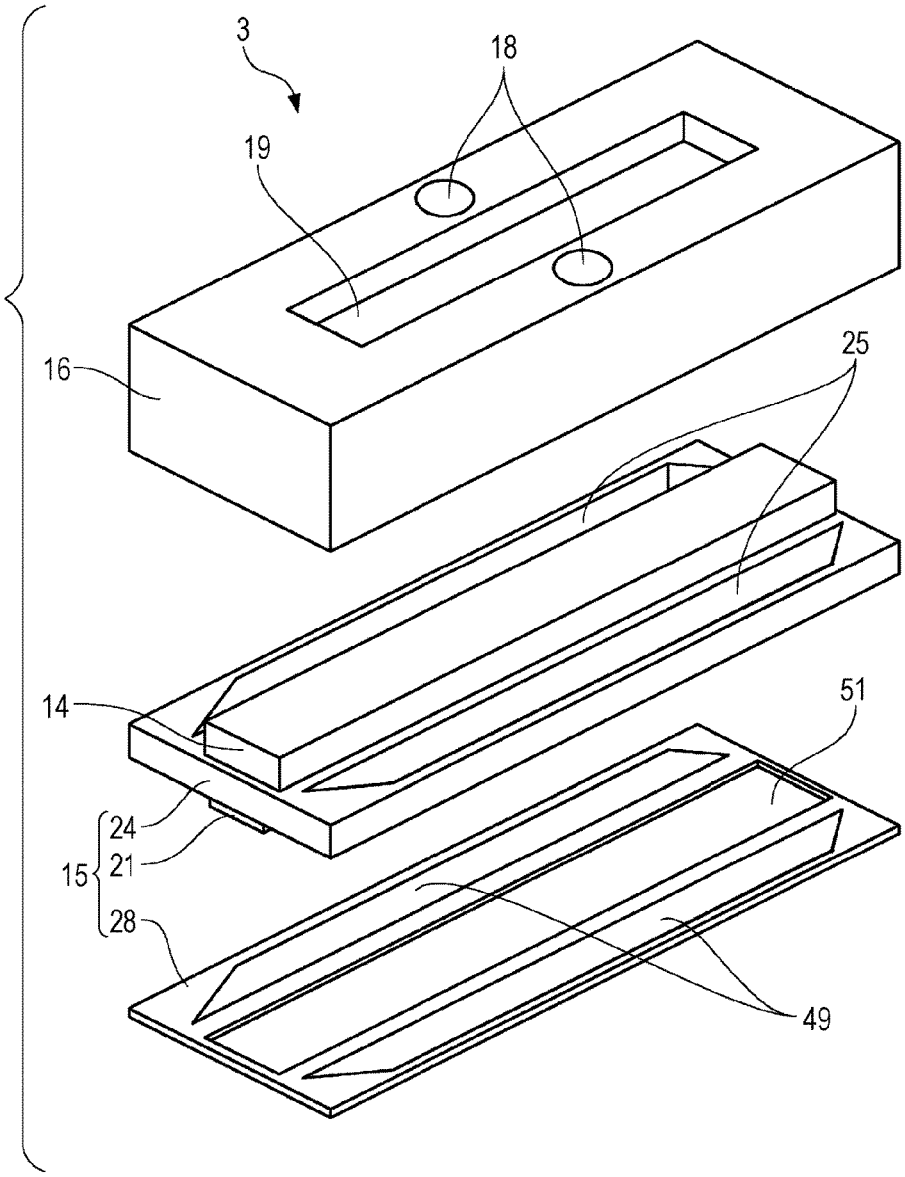
FIG. 2 is an exploded perspective view for illustrating a configuration of a recording head.
Figure 3:
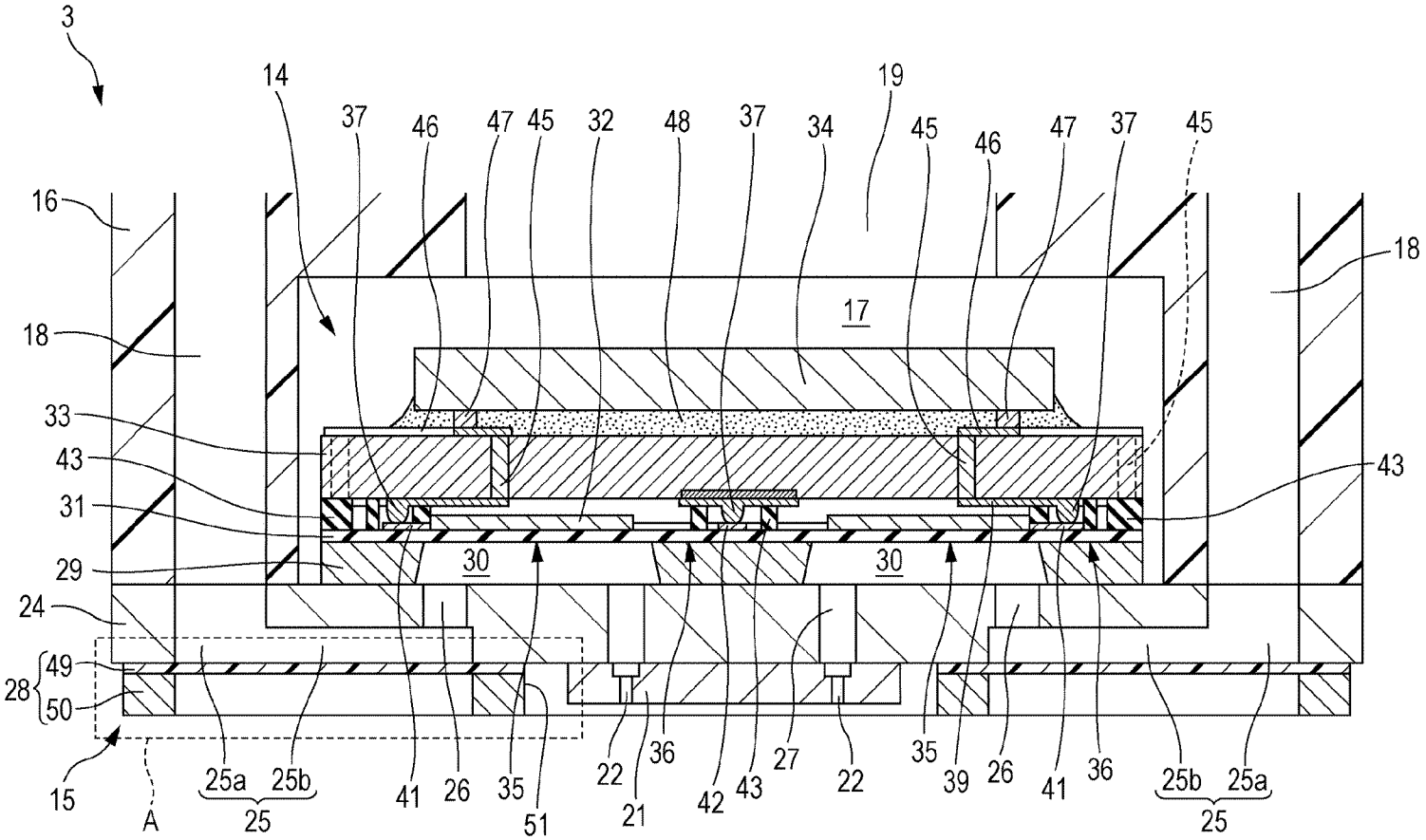
FIG. 3 is a cross-sectional view illustrating the configuration of the recording head.
Figure 4:
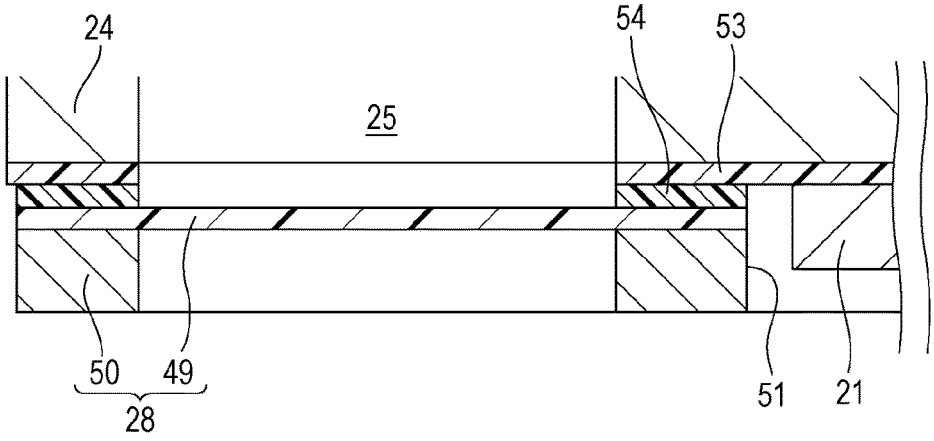
FIG. 4 is an enlarged view illustrating a region A in FIG. 3.

Next, the recording head 3 will be described. FIG. 2 is an exploded perspective view illustrating a configuration of the recording head 3. FIG. 3 is a cross-sectional view illustrating the configuration of the recording head 3. FIG. 4 is an enlarged view illustrating a region A in FIG. 3. In the following description, the laminating direction of each member is suitably described as a vertical direction. As illustrated in FIG. 2, the recording head 3 in the present embodiment is attached to a head case 16 in a state where an actuator unit 14 and a flow path unit 15 are laminated.

The head case 16 is a box-shaped member made of resin, and is formed in a state where a liquid introduction path 18 that supplies ink to each pressure chamber 30 passes through in a vertical direction. The liquid introduction path 18 is a space in which ink common to a plurality of pressure chambers 30 is stored along with a common liquid chamber 25 described below. In the present embodiment, two liquid introduction paths 18 are formed corresponding to the columns of pressure chambers 30 arranged in two columns in parallel. In addition, as illustrated in FIG. 3, in an inside of the head case 16, an accommodation space 17 recessed in a rectangular parallelepiped shape from a lower surface (surface on nozzle plate 21 side) to a middle of the head case 16 in the height direction of the head case 16. When the flow path unit 15 described below is bonded in a state of being positioned on a lower surface of the head case 16, an actuator unit 14 (pressure chamber forming substrate 29, sealing plate 33, driving IC 34, or the like) laminated on a communication substrate 24 is configured to be accommodated in the accommodation space 17. Further, in a portion of a ceiling surface of the accommodation space 17, an insertion opening 19 is formed which communicates the space outside the head case 16 and the accommodation space 17 with each other. An end portion of a wiring substrate such as a flexible printed substrate (FPC) (not illustrated) is inserted through the insertion opening 19 into the accommodation space 17 and is connected to the actuator unit 14 in the accommodation space 17.

As illustrated in FIG. 3, the actuator unit 14 in the present embodiment is laminated on the communication substrate 24 in a state where a pressure chamber forming substrate 29, a vibration plate 31, a piezoelectric element 32 which is a type of actuator, a sealing plate 33, and a driving IC 34 are laminated to be a unit. The actuator unit 14 is formed to be smaller than the accommodation space 17 so as to be capable of being accommodated in the accommodation space 17.

The pressure chamber forming substrate 29 is a silicon substrate constituting a lower portion (portion on flow path unit 15 side) of the actuator unit 14. A plurality of spaces that are to serve as the pressure chambers 30 are arranged along the nozzle column direction in parallel by a portion of the pressure chamber forming substrate 29 being removed in a plate thickness direction by etching or the like. A lower side of the space is divided by the communication substrate 24 and an upper side thereof is divided by the vibration plate 31 to constitute the pressure chamber 30. In addition, this space, that is, the pressure chamber 30 is formed in two columns corresponding to the nozzle columns formed in two columns. Each of the pressure chambers 30 is an empty portion elongated in a direction orthogonal to the nozzle column direction, and an individual communication path 26, which will be described below, communicates with an end portion on one side, and a nozzle communication path 27, which will be described below, communicates with an end portion on the other side thereof in the longitudinal direction.

The vibration plate 31 is an elastic thin film substrate and is laminated on the upper surface (surface opposite to flow path unit 15 side) of the pressure chamber forming substrate 29. An upper opening of the space to serve as the pressure chamber 30 is sealed by the vibration plate 31. In other words, the pressure chamber 30 is divided by the vibration plate 31. A portion of the vibration plate 31 corresponding to the pressure chamber 30 (specifically, upper opening of pressure chamber 30) functions as a displacement portion that is displaced in a direction away from or close to the nozzle 22 in accordance with flexural deformation of the piezoelectric element 32. In other words, a region corresponding to the upper opening of the pressure chamber 30 in the vibration plate 31 becomes a driving region 35 in which the flexural deformation is permitted. On the other hand, a region deviated from the upper opening of the pressure chamber 30 in the vibration plate 31 becomes a non-driving region 36 where flexural deformation is inhibited.

In addition, the vibration plate 31 includes, for example, an elastic film which is made of silicon dioxide ($SiO_2$) formed on an upper surface of the pressure chamber forming substrate 29 and an insulating film which is made of zirconium oxide ($ZrO_2$) formed on the elastic film. Piezoelectric elements 32 are laminated on a region corresponding to the respective pressure chambers 30 on the insulating film (surface on side opposite to pressure chamber forming substrate 29 side of vibration plate 31), that is, the driving region 35. The piezoelectric element 32 in the present embodiment is a so-called flexural mode of piezoelectric element. The piezoelectric element 32 is formed by a lower electrode layer, a piezoelectric layer, and an upper electrode layer, for example, on the vibration plate 31 being sequentially laminated. Any one of the upper electrode layer or the lower electrode layer becomes a common electrode formed commonly on the respective piezoelectric elements 32 and the other thereof becomes an individual electrode individually formed on each piezoelectric element 32. When an electric field corresponding to potential difference between the lower electrode layer and the upper electrode layer is applied between the lower electrode layer and the upper electrode layer, the piezoelectric element 32 deforms to be flexural in a direction away from or close to the nozzle 22. The piezoelectric elements 32 in the present embodiment are formed in two columns along the nozzle column direction corresponding to the pressure chambers 30 arranged in two columns in parallel along the nozzle column direction.

In addition, in the present embodiment, an individual terminal 41 and a common terminal 42 are laminated on the non-driving region 36 of the vibration plate 31. In other words, the individual terminal 41 and the common terminal 42 are formed on the upper surface of the vibration plate 31 (surface facing sealing plate 33). Specifically, the individual terminals 41 are formed on the outside of the column of one piezoelectric element 32 and the outside of the column of the other piezoelectric element 32 in a direction orthogonal to the nozzle column direction and the common terminal 42 is formed between columns of both piezoelectric elements 32. The individual terminal 41 is a terminal portion of the wiring extending from the individual electrode of the piezoelectric element 32 and is electrically connected to the individual electrode. The individual terminal 41 is formed for each piezoelectric element 32. On the other hand, the common terminal 42 is a terminal portion of the wiring extending from the common electrode of the piezoelectric element 32 and is electrically connected to the common electrode. The common terminal 42 in the present embodiment is connected to both the common electrode of a column of one piezoelectric element 32 and the common electrode of a column of the other piezoelectric elements 32. Corresponding bump electrodes 37 (described below) are in contact with the individual terminal 41 and the common terminal 42, respectively.

As illustrated in FIG. 3, the sealing plate 33 is a substrate which is made of silicon disposed to be formed an interval with respect to the piezoelectric element 32 in a state where a photosensitive adhesive 43 having an insulating property is interposed between the sealing plate 33 and the vibration plate 31. In the present embodiment, a plurality of bump electrodes 37 for outputting drive signals from the driving IC 34 to the piezoelectric element 32 side are formed on the lower surface (surface on pressure chamber forming substrate 29 side) of the sealing plate 33. As illustrated in FIG. 3, the bump electrodes 37 are formed at a position corresponding to one individual terminal 41 formed on the outside of one piezoelectric element 32, a position corresponding to the other individual terminal 41 formed on the outside of the other piezoelectric element 32, a position corresponding to the common terminal 42 formed between the columns of both the piezoelectric elements 32, and the like. Each bump electrode 37 is connected to a corresponding individual terminal 41 or common terminal 42 respectively. As the bump electrode 37, a so-called resin core bump made of a conductive layer covering a resin portion and the surface of the resin portion, a metal bump made of a metal such as gold (Au), or the like is suitably used. In addition, a lower surface side wiring 39 connected to the bump electrode 37 is formed on the lower surface (surface on pressure chamber forming substrate 29 side) of the sealing plate 33. As illustrated in FIG. 3, the lower surface side wiring 39 is connected to the upper surface side wiring 46 which is laminated on an upper surface (surface on side opposite to the pressure chamber forming substrate 29) of the sealing plate 33 via the through wiring 45 extending from the bump electrode 37 and passing through the sealing plate 33 in the thickness direction.

The driving IC 34 is an IC chip for driving the piezoelectric element 32, and is laminated on the upper surface of the sealing plate 33 via an adhesive 48 such as an anisotropic conductive film (ACF). As illustrated in FIG. 3, a plurality of IC terminals 47 connected to terminal portions of the upper surface side wiring 46 are formed on the lower surface (surface on sealing plate 33 side) of the driving IC 34. A plurality of IC terminals 47 corresponding to the individual terminals 41 of the IC terminals 47 are arranged in parallel along the nozzle column direction. In the present embodiment, two columns of IC terminals 47 are formed corresponding to the columns of piezoelectric elements 32 arranged in two columns in parallel.

The flow path unit 15 to which the actuator unit 14 and the head case 16 are bonded includes a communication substrate 24 (corresponding to first substrate in the invention), a nozzle plate 21 (corresponding to third substrate in the invention), and a compliance substrate 28. The communication substrate 24 is a substrate made of silicon, and in the present embodiment, is made of a silicon single crystal substrate whose crystal plane orientation of the surface (upper surface and lower surface) becomes a (110) plane. As illustrated in FIG. 3, the communication substrate 24 communicates with the liquid introduction path 18 and space serving as a common liquid chamber 25 (a type of flow path) which stores common ink in each of the pressure chambers 30, an individual communication path 26 which separately supplies ink from the liquid introduction path 18 to each pressure chamber 30 via the common liquid chamber 25, and a nozzle communication path 27 which communicates the pressure chamber 30 and the nozzle 22 are formed by anisotropic etching. The space that becomes the common liquid chamber 25 (that is, common liquid chamber 25) is an elongated space along the nozzle column direction and two spaces are formed corresponding to the liquid introduction path 18. In addition, the common liquid chamber 25 includes a first liquid chamber 25*a* which passes through the communication substrate 24 in the thickness direction and a second liquid chamber 25*b* which is formed in a state of remaining thin-walled portion by being recessed from a lower surface thereof (surface on side opposite to pressure chamber forming substrate 29 side) toward an upper surface (surface on pressure chamber forming substrate 29 side) to the middle of the plate thickness direction. A portion of an opening on the upper surface side of the first liquid chamber 25*a* communicates with the liquid introduction path 18 formed on the head case 16. In addition, the opening on the lower surface side (side opposite to head case 16 side) of the space which becomes the common liquid chamber 25 is sealed by the sealing film 49 (corresponding to second substrate in the invention) of the compliance substrate 28 described below. In other words, the lower surface of the common liquid chamber 25 is divided by the sealing film 49. The individual communication path 26 is formed in a state of passing through the thinned wall portion in the second liquid chamber 25*b*. A plurality of individual communication paths 26 are opened at positions corresponding to the pressure chambers 30 of the common liquid chamber 25. In other words, a plurality of the individual communication paths 26 are formed along the parallel arrangement direction of the pressure chambers 30 (in other words, in the nozzle column direction). Similarly, a plurality of nozzle communication paths 27 are also formed along the nozzle column direction.

The nozzle plate 21 is a substrate made of silicon (for example, a silicon single crystal substrate) bonded to the lower surface of the communication substrate 24. The nozzle plate 21 of the present embodiment is bonded to a region deviated from the compliance substrate 28 so as not to overlap with the compliance substrate 28. In other words, the nozzle plate 21 is bonded to a central region deviated from the opening on the lower surface side of the common liquid chamber 25 of the communication substrate 24. In this nozzle plate 21, a plurality of nozzles 22 (referred to as nozzle columns) are formed linearly (that is, in a column) along the longitudinal direction of the nozzle plate 21. In the present embodiment, two columns of nozzle columns are formed corresponding to the columns of the pressure chambers 30 formed in two columns. The plurality of nozzles 22 (nozzle columns) arranged in parallel are provided at equal intervals with a pitch corresponding to the dot formation density from the nozzle 22 on one end side to the nozzle 22 on the other end side.

The compliance substrate 28 is a substrate having flexibility bonded to a region corresponding to the common liquid chamber 25 on the lower surface of the communication substrate 24. In other words, the compliance substrate 28 is bonded to a region deviated from a region on the lower surface of the communication substrate 24 where the nozzle plate 21 is bonded. The compliance substrate 28 in the present embodiment is formed on an outer periphery of the nozzle plate 21 so as not to interfere with the nozzle plate 21. In other words, as illustrated in FIG. 2 and FIG. 3, an exposure opening 51 for exposing the nozzle plate 21 (specifically, nozzle surface 40) is formed in a central portion of the compliance substrate 28. Further, in the compliance substrate 28, a sealing film 49 having low rigidity and having flexibility is laminated on a rigid fixed substrate 50 made of metal or the like (stainless steel (SUS) in this embodiment). The sealing film 49 is a thin film-like substrate made of resin and adheres to the communication substrate 24. In other words, the compliance substrate 28 is bonded to the communication substrate 24 with the sealing film 49 side facing upward. In addition, a region facing the common liquid chamber 25 of the fixed substrate 50 is an opening portion removed in the thickness direction. Therefore, the lower surface of the common liquid chamber 25 is sealed only by the sealing film 49, and functions as a compliance portion that absorbs pressure fluctuation of the ink in the common liquid chamber 25. A configuration in which two compliance substrates are provided corresponding to the common liquid chambers formed in two columns and the compliance substrates are bonded to both sides between which the nozzle plate is sandwiched can be adopted.

Here, the nozzle plate 21 and the compliance substrate 28 adhere to the communication substrate 24 by an adhesive. Specifically, as illustrated in FIG. 4, the communication substrate 24 and the nozzle plate 21 adhere via a first adhesive layer 53 which is made of a silicone-based adhesive laminated on the lower surface of the communication substrate 24. On the other hand, the communication substrate 24 and the compliance substrate 28 adhere via a first adhesive layer 53 which is made of a silicone-based adhesive laminated on the lower surface of the communication substrate 24 and a second adhesive layer 54 which is made of an epoxy-based adhesive laminated on the first adhesive layer 53. The first adhesive layer 53 is an adhesive layer common to the nozzle plate 21 and the compliance substrate 28 and is formed on the entire lower surface excluding a region corresponding to the common liquid chamber 25 of the communication substrate 24. The second adhesive layer 54 is an adhesive which adheres the compliance substrate 28 and is formed between the first adhesive layer 53 and the compliance substrate 28. More specifically, the second adhesive layer 54 is formed on the sealing film 49 in a region where both the fixed substrate 50 and the sealing film 49 of the compliance substrate 28 are laminated. In other words, the second adhesive layer 54 is formed in a region where the compliance substrate 28 is bonded except for a region corresponding to the common liquid chamber 25 on the lower surface of the communication substrate 24.

In the present embodiment, the first adhesive layer 53 is made of a thermosetting and addition reaction type silicone-based adhesive and contains an epoxy group. Accordingly, by including the epoxy group in the first adhesive layer 53, the adhesion (that is, adhesive force) between the first adhesive layer 53 and the second adhesive layer 54 can be increased. In other words, when the first adhesive layer 53 is formed on the lower surface of the communication substrate 24, adhesion between the second adhesive layer 54 made of an epoxy-based adhesive and the first adhesive layer 53 can be increased by the first adhesive layer 53 being formed so that the epoxy group remains on the surface (surface on side of second adhesive layer 54). As a result, peeling at the interface between the first adhesive layer 53 and the second adhesive layer 54 can be suppressed. In addition, in the present embodiment, in a cured state, the Young's modulus of the first adhesive layer 53 is less than the Young's modulus of the second adhesive layer 54. In other words, the first adhesive layer 53 is softer than the second adhesive layer 54. For example, the Young's modulus of the first adhesive layer 53 is about 2 GPa and the Young's modulus of the second adhesive layer 54 is about 7 GPa. Accordingly, during heating when the compliance substrate 28 and the communication substrate 24 adhere to each other, even if shear stress is generated between the communication substrate 24 and the compliance substrate 28 due to the difference between the coefficient of linear expansion of the communication substrate 24 and the coefficient of linear expansion of the compliance substrate 28, this stress can be relieved by the second adhesive layer 54. As a result, peeling of the compliance substrate 28 from the communication substrate 24 can be suppressed. Further, the surface free energy of the first adhesive layer 53 is less than the surface free energy of the communication substrate 24. In other words, the surface of the first adhesive layer 53 has higher liquid repellency than the surface of the communication substrate 24, for example, the contact angle is 80 to 100 degrees. Therefore, when the compliance substrate 28 adheres to the communication substrate 24, even if the second adhesive layer 54 in a liquid state is formed on the surface of the cured first adhesive layer 53, flowing out of an epoxy-based adhesive from the second adhesive layer 54 to the communication substrate 24 side can be prevented. The method for adhering the nozzle plate 21 and the compliance substrate 28 to the communication substrate 24 will be described below in detail.

As described above, since the compliance substrate 28 is bonded to the communication substrate 24 side via the second adhesive layer 54 which is an epoxy-based adhesive, decrease in the adhesive force of the first adhesive layer 53 made of a silicon-based adhesive can be suppressed by components included in the sealing film 49 made of resin. In other words, it is possible to prevent the components included in the sealing film 49 from becoming a catalyst poison, curing of the first adhesive layer 53 from being inhibited, or the adhesive force from being decreased. As a result, peeling of the compliance substrate 28 can be suppressed, and the reliability of the recording head 3, and according to this, the reliability of the printer 1 can be increased. Although it is considered that the compliance substrate 28 and the communication substrate 24 can adhere to each other by only the second adhesive layer 54, as described above, in a case where a shear stress is generated between the communication substrate 24 and the compliance substrate 28, there is a fear that the compliance substrate 28 may be peeled off from the communication substrate 24. In addition, although it is also considered that, as the second adhesive layer 54, an epoxy-based adhesive having a low Young's modulus is cured, there is a fear that such an adhesive has a low cross linking density and swells when being exposed to ink. Regarding to this, in the present embodiment, since the sealing film 49 is bonded to the communication substrate 24 via the first adhesive layer 53 which is a silicone-based adhesive and the second adhesive layer 54 which is an epoxy-based adhesive having a higher Young's modulus than the first adhesive layer 53, it is difficult to swell even when being exposed to ink, and a resistance to the shear stress between the communication substrate 24 and the compliance substrate 28 can be increased.

In the present embodiment, a silicone-based adhesive is used as the adhesive of a portion which is exposed to ink other than the bonding portion between the compliance substrate 28 and the communication substrate 24. Specifically, the bonding portion of the communication substrate 24 and the nozzle plate 21, the bonding portion between the head case 16 and the communication substrate 24, and the bonding portion between the communication substrate 24 and the pressure chamber forming substrate 29, which are described above, are bonded by a silicone-based adhesive.

Next, a method for manufacturing a liquid ejecting head, particularly a method for adhering the nozzle plate 21 and the compliance substrate 28 to the communication substrate 24 will be described in detail. FIG. 5 to FIG. 10 are state transition diagrams in a region A for illustrating a method for adhering the nozzle plate 21 and the compliance substrate 28 to the communication substrate 24. In the method for applying the adhesive in this embodiment, a transfer method is adopted, in which the adhesive is temporarily transferred to the film 55 and the adhesive on the film 55 is transferred to the communication substrate 24 or the compliance substrate 28.

First, in the first adhesive layer 53 curing process, a first adhesive layer 53 made of a silicone-based adhesive is formed on the lower surface of the communication substrate 24 and the first adhesive layer 53 is cured while the nozzle plate 21 is pressed against the lower surface of the communication substrate 24. Specifically, a first adhesive layer forming process of forming a the first adhesive layer 53 in a semi-cured state having a curing degree advanced from a liquid state on the lower surface of the communication substrate 24 and then a fully curing process of fully curing the first adhesive layer 53 in the semi-cured state.

Figure 5:
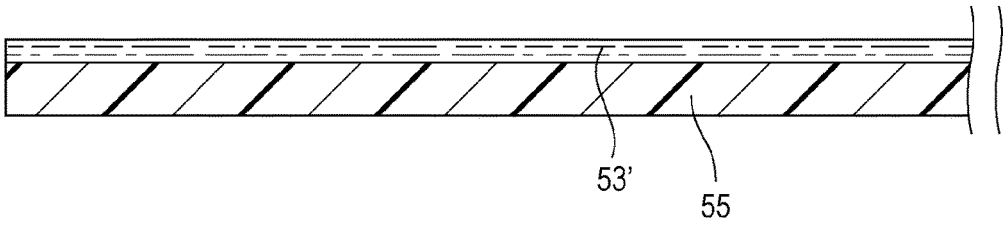
FIG. 5 is a state transition diagram illustrating a method for manufacturing the recording head.
Figure 6:
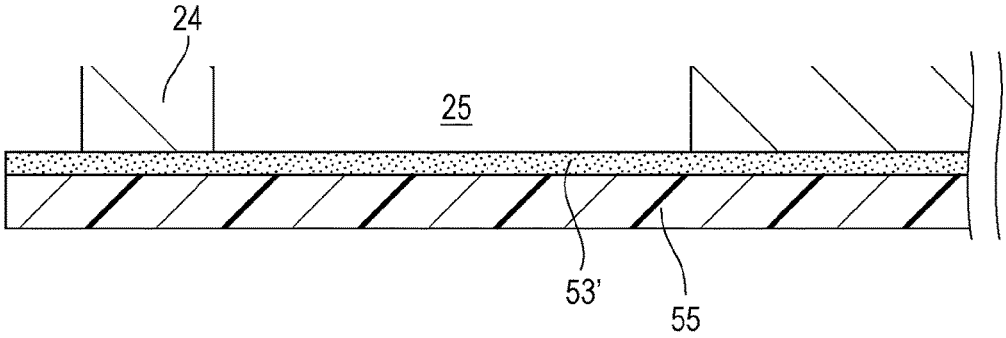
FIG. 6 is state transition diagram illustrating a method for manufacturing the recording head.
Figure 7:
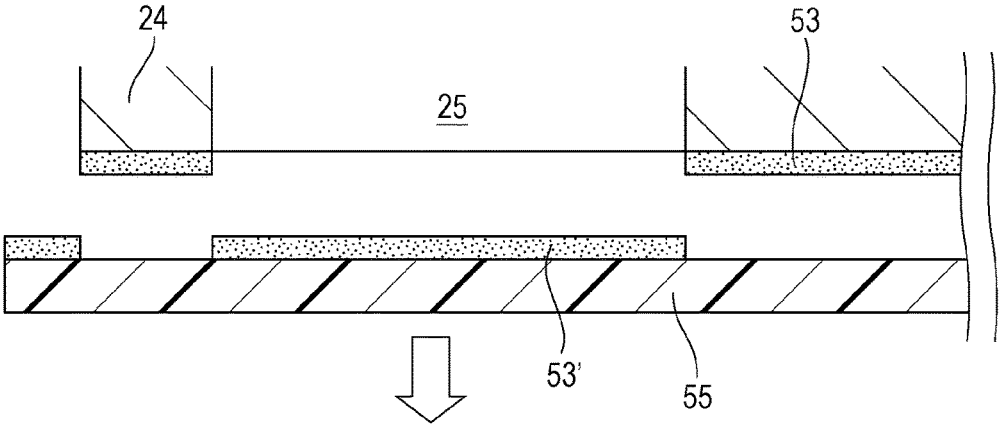
FIG. 7 is a state transition diagram illustrating a method for manufacturing the recording head.

More specifically, as illustrated in FIG. 5, in the first adhesive layer forming process, a silicone-based adhesive including an epoxy group (hereinafter referred to as first adhesive 53') is transferred onto the film 55. Specifically, although not illustrated, a screen plate is disposed on a stage, a first adhesive 53' is disposed on a predetermined position on the stage 53' by the first adhesive 53' in a liquid state being applied and squeezed. The film 55 is in contact with the first adhesive 53' on the stage and the first adhesive 53' is transferred to the film 55. Accordingly, as illustrated in FIG. 5, the first adhesive 53' in a liquid state is formed on the film 55. In the state, the film 55 is placed on, for example, a hot plate or the like and heated to such an extent that the first adhesive 53' is not fully cured. Accordingly, the first adhesive 53' is semi-cured and the fluidity of the first adhesive 53' is in a suppressed state. For example, the viscosity of the first adhesive 53' becomes several tens Pa·s to several hundred Pa·s. The first adhesive 53' in the semi-cured state is transferred to the lower surface of the communication substrate 24. In other words, as illustrated in FIG. 6, a surface on which the first adhesive 53' is formed faces the lower surface of the communication substrate 24 and then the film 55 is attached to the communication substrate 24. In FIG. 6, although the lower surface (surface on which the first adhesive layer 53 is formed) of the communication substrate 24 is in a state of facing downward, actually, in a state where the lower surface of the communication substrate 24 faces upward, the film 55 is close to the communication substrate 24 from above and then the first adhesive 53' is in contact with the communication substrate 24. Next, as illustrated in FIG. 7, the film 55 is peeled off from the communication substrate 24. Accordingly, the first adhesive layer 53 in a semi-cured state is formed on a region other than the region of the lower surface of the communication substrate 24 which becomes the common liquid chamber 25 (that is, lower surface side opening of common liquid chamber 25). Accordingly, by the first adhesive layer 53 being in the semi-cured state, the epoxy group is likely to remain on the surface of the first adhesive layer 53 after being transferred to the communication substrate 24.

Figure 8:
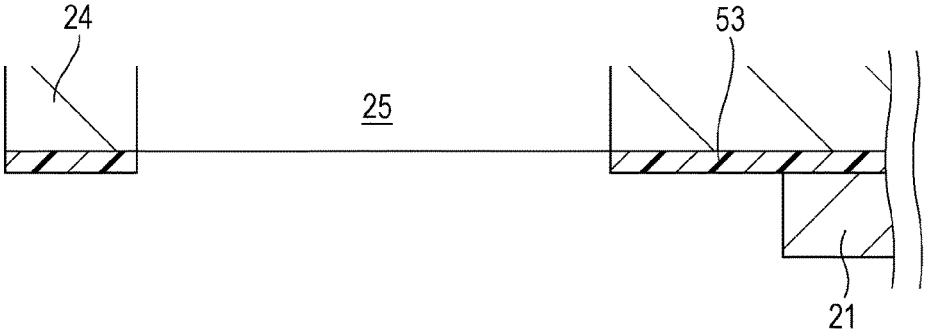
FIG. 8 is a state transition diagram illustrating a method for manufacturing the recording head.

Thereafter, as illustrated in FIG. 8, in the fully curing process, the nozzle plate 21 is pressed against the lower surface of the communication substrate 24 in a state where the relative positions of the communication substrate 24 and the nozzle plate 21 are matched each other. In other words, the first adhesive layer 53 in a semi-cured state is sandwiched between the communication substrate 24 and the nozzle plate 21, and the nozzle plate 21 and the communication substrate 24 are pressed toward each other to be close to each other. In this state, the first adhesive layer 53 in the semi-cured state is fully cured by heating. Accordingly, the nozzle plate 21 is bonded to the communication substrate 24. In addition, a region deviated from the nozzle plate 21 of the lower surface of the communication substrate 24 is in a state where the first adhesive layer 53 in the fully curing state is exposed.

Figure 9:
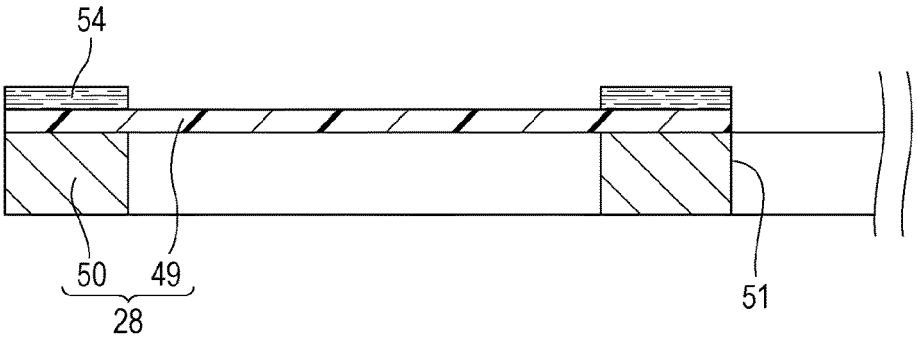
FIG. 9 is a state transition diagram illustrating a method for manufacturing the recording head.

Next, the second adhesive layer 54 is cured in a state where the first adhesive layer 53 and the second adhesive layer 54 are sandwiched between the communication substrate 24 and the compliance substrate 28 and a second adhesive layer curing process of adhering the communication substrate 24 and the compliance substrate 28 to each other proceeds. Specifically, first, a second adhesive layer 54 made of an epoxy-based adhesive is formed on any one of the surface of the first adhesive layer 53 laminated on the communication substrate 24 or the surface (that is, sealing film 49) of one side facing the communication substrate 24 of the compliance substrate 28. In the present embodiment, as illustrated in FIG. 9, the second adhesive layer 54 in a liquid state is applied to a predetermined position on the sealing film 49 of the compliance substrate 28, for example, by a transfer method. In the case where the second adhesive layer 54 is applied to the one side of the compliance substrate 28 as in the present embodiment, the application of the second adhesive layer 54 can be performed in parallel with the first adhesive layer curing process.

Figure 10:
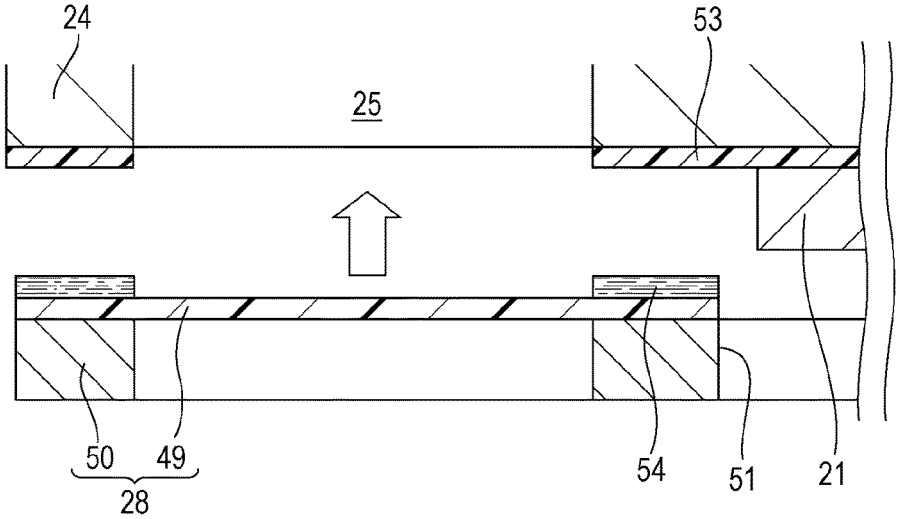
FIG. 10 is a state transition diagram illustrating a method for manufacturing the recording head.

Thereafter, as illustrated in FIG. 10, the compliance substrate 28 on which the second adhesive layer 54 is formed is close to the communication substrate 24 side, and the compliance substrate 28 adheres to the communication substrate 24. In other words, between the communication substrate 24 and the compliance substrate 28, the first adhesive layer 53 in a fully cured state and the second adhesive layer 54 in the liquid state are sandwiched between the communication substrate 24 and the compliance substrate 28, the communication substrate 24 and the compliance substrate 28 is pressed in an approaching direction to each other. Here, since the surface of the first adhesive layer 53 is higher in liquid repellency than the surface of the communication substrate 24, the epoxy-based adhesive forming the second adhesive layer 54 is pushed out by pressing and thus it can be prevented from flowing out to the communication substrate 24 side. In addition, since the first adhesive layer 53 contains an epoxy group, the adhesion between the first adhesive layer 53 and the second adhesive layer 54 can be increased.

Heating is performed in a pressed state in which the communication substrate 24 and the compliance substrate 28 are pressed and the second adhesive layer 54 in the liquid state is fully cured. At this time, the compliance substrate 28 and the communication substrate 24 are expanded by heating. As described above, since the compliance substrate 28 includes the fixed substrate 50 made of SUS and the sealing film 49 made of resin and the communication substrate 24 is made of a silicon single crystal substrate, expansion degrees differ from each other between the compliance substrate 28 and the communication substrate 24. Specifically, the compliance substrate 28 expands more than the communication substrate 24. In the expanded state, since the second adhesive layer 54 is cured, thereafter, when heating is stopped and the compliance substrate 28 and the communication substrate 24 are cooled to room temperature, a shear stress is generated between the compliance substrate 28 and the communication substrate 24. However, in the present embodiment, since the second adhesive layer 54 and the first adhesive layer 53 having a lower Young's modulus than the second adhesive layer 54 are provided between the compliance substrate 28 and the communication substrate 24, the shear stress can be relieved. In other words, the shear stress can be relieved by the first adhesive layer 53 provided between the second adhesive layer 54 and the communication substrate 24. As a result, peeling of the compliance substrate 28 from the communication substrate 24 can be suppressed. In other words, the communication substrate 24 can be firmly bonded by the compliance substrate 28. Accordingly, the flow path unit 15 is created.

When the flow path unit 15 is manufactured, the actuator unit 14 and the flow path unit 15 are bonded. By bonding the flow path unit 15 to which the actuator unit 14 is bonded to the lower surface of the head case 16, the actuator unit 14 is accommodated in the accommodation space 17 and the recording head 3 is created. The timing of bonding the nozzle plate 21 and the compliance substrate 28 to the communication substrate 24 is not limited to the embodiment described above. For example, before the nozzle plate 21 and the compliance substrate 28 are bonded to the communication substrate 24, the actuator unit 14 can be bonded to the communication substrate 24. Further, before bonding the nozzle plate 21 and the compliance substrate 28 to the communication substrate 24, the actuator unit 14 and the head case 16 can be bonded to the communication substrate 24.

Accordingly, since the first adhesive layer 53 is cured prior to the adhesion of the compliance substrate 28 to the communication substrate 24, decrease in the adhesive force of the first adhesive layer 53 can be suppressed by the components included in the sealing film of the compliance substrate 28. In addition, since the first adhesive layer 53 is formed in the semi-cured state on the communication substrate 24 and then cured, migration of the epoxy group from the surface to an inside portion of the first adhesive layer 53 can be suppressed. In other words, by the first adhesive layer 53 being in a semi-cured state, flowability of the adhesive can be suppressed and migration of epoxy group can be suppressed. As a result, the epoxy group can be remained on the surface of the first adhesive layer 53 after fully cured, and the adhesion between the first adhesive layer 53 and the second adhesive layer 54 can be increased.

In the embodiment described above, although the compliance substrate 28 is configured by the fixed substrate 50 and the sealing film 49, it is not limited thereto. For example, the compliance substrate can be adopted that is made only of resin in which the plate thickness of the region corresponding to the common liquid chamber is thinned by etching or the like and the plate thickness of the other region is increased. In this case, the compliance substrate is the second substrate in the present invention. In addition, in the embodiment described above, although the communication substrate 24 and the nozzle plate 21 are bonded to each other via the first adhesive layer 53, it is not limited thereto. For example, the communication substrate 24 and the nozzle plate 21 can be bonded via another adhesive (adhesive layer). Further, in the embodiment described above, although the recording head 3 provided with the driving IC 34 on the sealing plate 33 is described as an example, it is not limited thereto. For example, a configuration in which a driving circuit is formed on the sealing plate itself can be adopted without providing a driving IC on the sealing plate.

Figure 11:
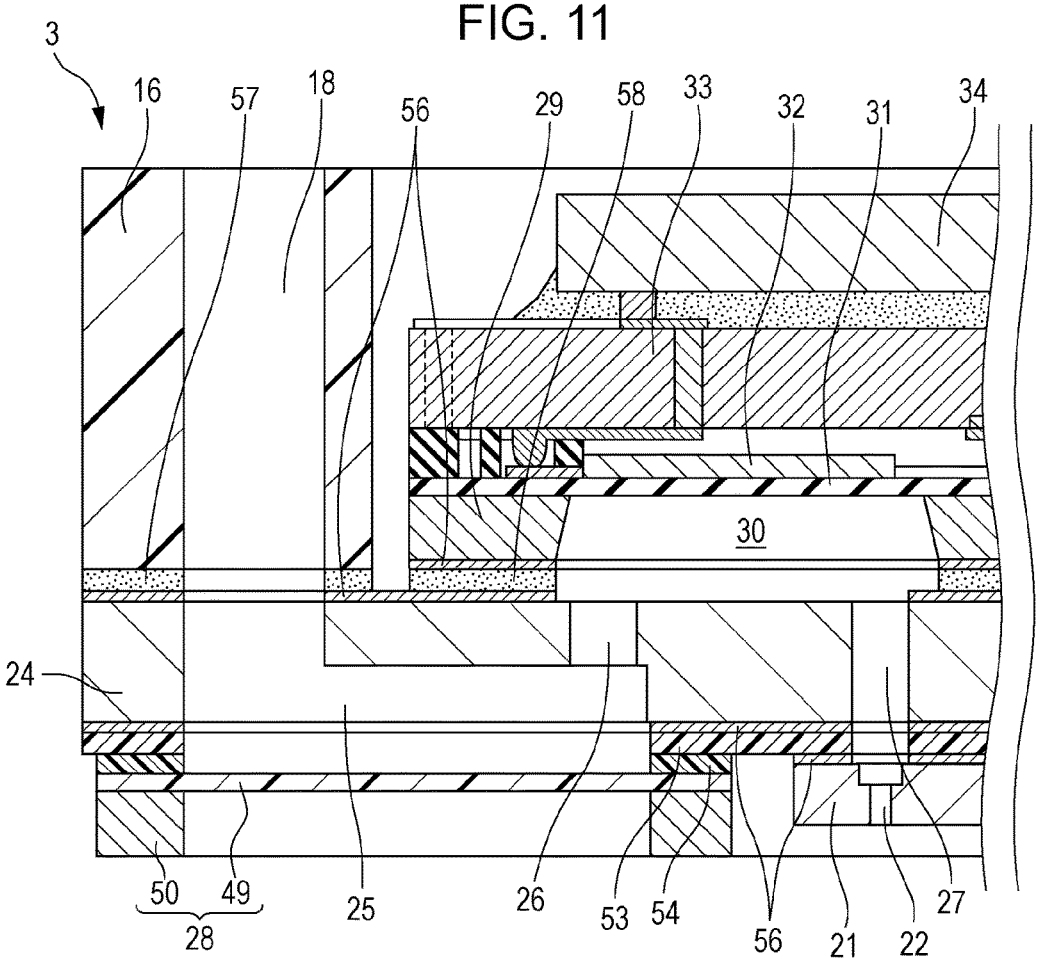
FIG. 11 is a cross-sectional view illustrating a configuration of a recording head according to a second embodiment.

In addition, in a case where an addition reaction type silicone-based adhesive including a curing acceleration catalyst for accelerating the curing of the adhesive as the first adhesive layer 53, it is preferable that a co-catalyst layer be provided in a region where the first adhesive layer 53 is laminated. For example, in the second embodiment illustrated in FIG. 11, a co-catalyst layer 56 is provided on the lower surface of the communication substrate 24. FIG. 11 is an enlarged sectional view of the main portion of the recording head 3 in a second embodiment.

Specifically, as illustrated in FIG. 11, the co-catalyst layer 56 is formed on a region of the lower surface of the communication substrate 24 where the first adhesive layer 53 is laminated. In the present embodiment, the co-catalyst layer 56 is also formed on a region of the upper surface of the nozzle plate 21 where the first adhesive layer 53 is laminated. In addition, in a third adhesive layer 57 for adhering the head case 16 and the communication substrate 24 and a fourth adhesive layer 58 for adhering the pressure chamber forming substrate 29 and the communication substrate 24, an addition reaction type silicone-based adhesive including a curing acceleration catalyst is used, as in the first adhesive layer 53. Therefore, in the region where the third adhesive layer 57 is laminated and the region where the fourth adhesive layer 58 is laminated, of the upper surface of the communication substrate 24, and in a region of the lower surface of the pressure chamber forming substrate 29 where the fourth adhesive layer 58 is laminated, the co-catalyst layer 56 is also formed.

Figures 12, 13:
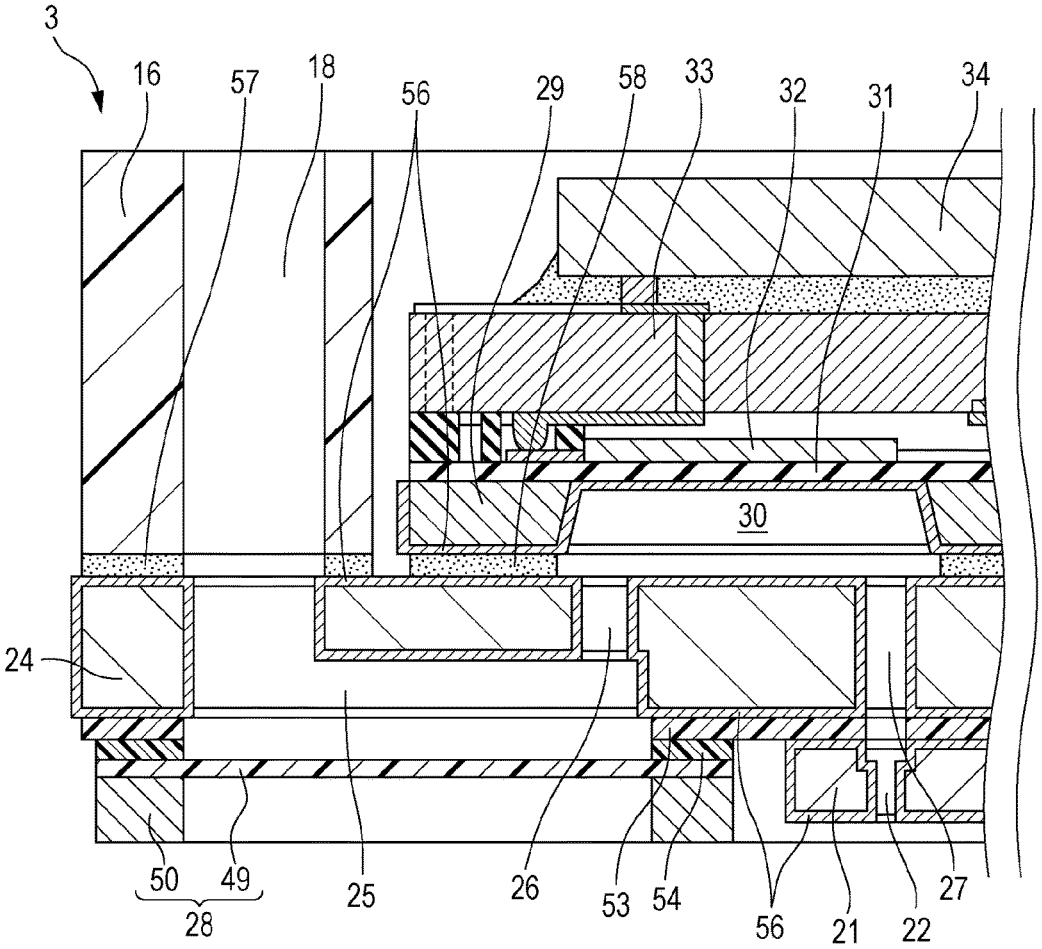
FIG. 12 is a table illustrating the results of measuring an adhesive strength of a silicone-based adhesive in various materials.
FIG. 13 is a cross-sectional view illustrating a configuration of a recording head according to the second embodiment.

Here, the curing acceleration catalyst accelerates the curing of the silicone-based adhesive, and for example, platinum (Pt) or a catalyst including platinum (Pt) is suitably used. In addition, the co-catalyst layer 56 is a layer capable of improving the effect (that is, effect of accelerating curing) by the curing acceleration catalyst, and for example, tantalum oxide ($TaO_x$) or the layer including tantalum oxide ($TaO_x$) is suitably used. FIG. 12 is a table showing the results of measuring the adhesive strength of an addition reaction type silicone-based adhesive including platinum (Pt) using various materials. In a measurement experiment, a plate on which tantalum oxide ($TaO_x$) is formed to a thickness of 10 nm on the surface of SUS (TaOx in FIG. 12), a SUS plate (SUS in FIG. 12), an aluminum plate (Al in FIG. 12), and an iron plate (Fe in FIG. 12) were prepared by two each, the two plates were adhere using an addition reaction type silicone-based adhesive including platinum (Pt), and then the shear strength was measured. The case where the shear strength was 10 MPa or more was evaluated as ⊙, the case where the shear strength was 2 MPa or more and less than 10 MPa was evaluated as ○, and the case where the shear strength was 2 MPa or less was evaluated as ×. As illustrated in FIG. 13, all the case of SUS plate (SUS), aluminum plate (Al), and iron plate (Fe) was indicated as ○. On the other hand, the plate ($TaO_x$) on which the tantalum oxide ($TaO_x$) was formed on the surface of the SUS was indicated as ⊙ and it was found that the shear strength was increased. In other words, in a case where tantalum oxide ($TaO_x$) is present on the surface, it was found that the adhesive strength of the addition reaction type silicone-based adhesive including platinum (Pt) was increased.

As described above, since the co-catalyst layer 56 including tantalum oxide ($TaO_x$) is formed on the region of the lower surface of the communication substrate 24 where the first adhesive layer 53 is laminated, an effect of curing acceleration catalyst including platinum (Pt) (that is, effect of accelerating curing of first adhesive layer 53) can be increased. Accordingly, the adhesive strength of the first adhesive layer 53 can be increased. As a result, the bonding strength between the communication substrate 24 and the compliance substrate 28 and the bonding strength between the communication substrate 24 and the nozzle plate 21 can be increased. In addition, since the co-catalyst layer 56 is formed also on a region of the upper surface of the nozzle plate 21 where the first adhesive layer 53 is laminated, the bonding strength between the communication substrate 24 and the nozzle plate 21 can be further increased. Further, in this embodiment, since the co-catalyst layer 56 is formed on a region of the upper surface of the communication substrate 24 where the third adhesive layer 57 is laminated, the bonding strength between the head case 16 and the communication substrate 24 can be increased. Since the co-catalyst layer 56 is formed on a region on the upper surface of the communication substrate 24 where the fourth adhesive layer 58 is laminated and a region of the lower surface of the pressure chamber forming substrate 29 where the fourth adhesive layer 58 is laminated, respectively, the bonding strength between the pressure chamber forming substrate 29 and the communication substrate 24 can be increased. Although it is preferable that the co-catalyst layer 56 be formed on both two substrates to be bonded, the co-catalyst layer may be formed on only any one of the substrates.

In addition, each co-catalyst layer 56 is formed using, for example, an atomic layer deposition method (ALD method), a CVD method, or the like, before an adhesive is applied to the surface of each substrate. The method for forming the co-catalyst layer 56 is not limited thereto, and any method may be used as long as it is a film forming method having high adhesion to the substrate. The co-catalyst layer 56 on the lower surface of the communication substrate 24 and the co-catalyst layer 56 on the nozzle plate 21 are formed on a region where the first adhesive layer 53 is to be laminated by the ALD method or the like before the first adhesion process. In addition, before the third adhesive layer 57 and the fourth adhesive layer 58 are applied to the communication substrate 24 by the ALD method or the like, the co-catalyst layer 56 on the upper surface of the communication substrate 24 is formed on a region on which the third adhesive layer 57 and the fourth adhesive layer 58 are to be laminated. Further, the co-catalyst layer 56 of the pressure chamber forming substrate 29 is formed on a region on which the fourth adhesive layer 58 is to be laminated before the fourth adhesive layer 58 is applied to the pressure chamber forming substrate 29 by the ALD method or the like. Since a configuration of the other recording head 3 and the method for manufacturing the recording head 3 are the same as those of the first example, the description thereof will be omitted.

A region where the co-catalyst layer 56 is formed is not limited to only a region where the adhesive layer is laminated. For example, in the third embodiment illustrated in FIG. 13, the co-catalyst layer 56 is provided on the entire surface including the wall surface of the flow path in an inside portion of the communication substrate 24. FIG. 13 is an enlarged sectional view of the main portion of the recording head 3 in the third embodiment.

Specifically, as illustrated in FIG. 13, a co-catalyst layer 56 is formed on the upper surface, the side surfaces, the lower surface of the communication substrate 24, and the inner wall surfaces of the flow paths in the inside portion (that is, common liquid chamber 25, individual communication path 26 and nozzle communication path 27). Further, the co-catalyst layer 56 is formed on the lower surface, the side surfaces of the pressure chamber forming substrate 29 and the inner wall surface (including lower surface of the vibration plate 31) of the pressure chamber 30. Further, a co-catalyst layer 56 is formed on the upper surface, the side surfaces, the lower surface of the nozzle plate 21, and the inner wall surface of the nozzle 22. In other words, in the present embodiment, the co-catalyst layer 56 is formed not only on a region where the adhesive layer is laminated but also on the inner wall surface of a series of flow paths from the common liquid chamber 25 to the nozzle 22. Accordingly, by forming the co-catalyst layer 56, in the region where the adhesive layer is laminated, the adhesive strength by each adhesive layer can be increased. In addition, the co-catalyst layer 56 on the inner wall surface of the flow path functions as a protective film having ink resistance, and erosion of each substrate forming the flow path can be suppressed by the ink. Since the configuration of the other recording head 3 and the method for manufacturing the recording head 3 are the same as those of the second example, the description thereof will be omitted.

In the above embodiment, although the ink jet type recording head 3 is described as an example of the liquid ejecting head, the invention can be also applied to other liquid ejecting heads. The invention can be applied to a color material ejecting head which is used for manufacturing a color filter of a liquid crystal display or the like, an electrode material ejecting head which is used for forming an electrode of an organic Electro Luminescence (EL) display, a face emitting display (FED), or the like, a bioorganic ejecting head which is used for manufacturing a biochip (biochemical element), or the like, for example. A solution of each color material of red (R), green (G), and blue (B) is ejected as a kind of liquid from a color material ejecting head for the display manufacturing apparatus. In addition, a liquid electrode material is injected as a kind of liquid from the electrode material ejecting head for an electrode forming apparatus, and a solution of bioorganic matter is ejected as a kind of liquid from the bioorganic ejecting head for a chip manufacturing apparatus.

The entire disclosure of Japanese Patent Application No. 2016-183926, filed Sep. 21, 2016 and 2016-227447, filed Nov. 24, 2016 are expressly incorporated by reference herein.

What is claimed is:

1. A liquid ejecting head comprising:

a first substrate in which a space serving as a flow path is formed in a state of having an opening on a surface of one side thereof; and a second substrate which seals the opening from the surface on the one side of the first substrate, provides the flow path, and is made of resin, wherein the first substrate and the second substrate adhere to each other via a first adhesive layer which is laminated on the surface on the one side of the first substrate and which is made of a silicone-based adhesive and a second adhesive layer which is laminated on the first adhesive layer and which is made of an epoxy-based adhesive, and wherein a Young's modulus of the first adhesive layer is less than that of the second adhesive layer.

2. The liquid ejecting head according to claim 1, further comprising:

a third substrate which adheres to a region deviating from a region on the surface on the one side of the first substrate where the second substrate adheres, and wherein the first substrate and the third substrate adhere to each other via the first adhesive layer laminated on the surface on the one side of the first substrate.

3. The liquid ejecting head according to claim 1, wherein the first adhesive layer contains an epoxy group.

4. The liquid ejecting head according to claim 1, wherein the first adhesive layer includes a curing acceleration catalyst including platinum, and wherein a co-catalyst layer including tantalum oxide is formed on a region of the surface on the one side of the first substrate where at least the first adhesive layer is laminated.

5. A liquid ejecting apparatus comprising:

the liquid ejecting head according to claim 1.

6. A liquid ejecting apparatus comprising:

the liquid ejecting head according to claim 2.

7. A liquid ejecting apparatus comprising:

the liquid ejecting head according to claim 3.

8. A liquid ejecting apparatus comprising:

the liquid ejecting head according to claim 5.

9. A method for manufacturing a liquid ejecting head which includes a first substrate in which a space serving as a flow path is formed in a state of having an opening on a surface of one side thereof and a second substrate which seals the opening from the surface on the one side of the first substrate, divides the flow path, and is made of resin, the method comprising:

forming a first adhesive layer made of a silicon-based adhesive on the surface on the one side of the first substrate and curing the first adhesive layer; and forming a second adhesive layer made of an epoxy-based adhesive on any one of a surface of the first adhesive layer laminated on the first substrate or a surface on one side of the second substrate facing the first substrate and adhering the first substrate and the second substrate to each other by curing the second adhesive layer in a state where the first adhesive layer and the second adhesive layer are sandwiched between the first substrate and the second substrate, wherein a Young's modulus of the first adhesive layer is less than that of the second adhesive layer.

10. The method for manufacturing a liquid ejecting head according to claim 9, wherein the first adhesive layer contains an epoxy group, and wherein the forming of the first adhesive layer includes forming the first adhesive layer in a semi-cured state in which a curing degree is progressed from the liquid state on the surface on the one side of the first substrate and fully curing the first adhesive layer in the semi-cured state after the forming of the first adhesive layer.

11. The method for manufacturing a liquid ejecting head according to claim 9, wherein the first adhesive layer includes a curing acceleration catalyst including platinum, and wherein a co-catalyst layer including tantalum oxide is formed on a region on the surface on the one side of the first substrate where at least the first adhesive layer is laminated.

* * * * *